US009296523B2

(12) United States Patent
Untch et al.

(10) Patent No.: US 9,296,523 B2
(45) Date of Patent: Mar. 29, 2016

(54) LOCK WITH TWO PROFILE STRIPS AND SLIDERS FOR CONNECTING AND SEPARATING SUCH LOCKS

(75) Inventors: Guenter Untch, Muellheim (DE); Peter Lais, Muellheim (DE); Martin Koch, Neuenburg (DE)

(73) Assignee: Flecotec AG, Muellheim (DE)

( * ) Notice: Subject to any disclaimer, the term of this patent is extended or adjusted under 35 U.S.C. 154(b) by 202 days.

(21) Appl. No.: 13/298,945

(22) Filed: Nov. 17, 2011

(65) Prior Publication Data

US 2012/0124789 A1 May 24, 2012

(30) Foreign Application Priority Data

Nov. 18, 2010 (DE) ..... 20 2010 015 525 U

(51) Int. Cl.

| | |
|---|---|
| ***A44B 19/04*** | (2006.01) |
| ***B65D 33/25*** | (2006.01) |
| ***B65B 1/28*** | (2006.01) |
| ***B65B 39/00*** | (2006.01) |
| ***B65B 69/00*** | (2006.01) |

(52) U.S. Cl.

CPC ..... *B65D 33/2591* (2013.01); *B65B 1/28* (2013.01); *B65B 39/00* (2013.01); *B65B 69/00* (2013.01); *Y10T 24/2513* (2015.01); *Y10T 24/2545* (2015.01)

(58) Field of Classification Search

CPC ..... B65D 33/2591; B65B 1/28; B65B 39/00; Y10T 24/2532

USPC ..... 141/315, 313, 314, 383, 386; 383/64, 383/37, 61.3, 63; 24/382, 383, 415, 427, 24/400

See application file for complete search history.

(56) References Cited

U.S. PATENT DOCUMENTS

| | | | | |
|---|---|---|---|---|
| 2,229,216 | A * | 1/1941 | Marinsky | 24/382 |
| 3,726,329 | A * | 4/1973 | Dean | 150/111 |
| 7,104,293 | B2 * | 9/2006 | Lais et al. | 141/302 |
| 7,487,808 | B2 * | 2/2009 | Stoye et al. | 141/315 |
| 2008/0276435 | A1 * | 11/2008 | Koch et al. | 24/400 |
| 2012/0090279 | A1 | 4/2012 | Untch | |
| 2012/0124789 | A1 | 5/2012 | Untch et al. | |

FOREIGN PATENT DOCUMENTS

WO WO 2010/121793 A1 10/2010

* cited by examiner

*Primary Examiner* — Abigail Morrell

(74) *Attorney, Agent, or Firm* — Muirhead and Saturnelli, LLC

(57) ABSTRACT

A lock system includes a first lock and a second lock each with two profile strips operable for engagement with an at least partially flexible bundle and effective to enable a connection of a first bundle with a second bundle in a closed docking position and for guidance of a flow in a flow direction through lock members from the first bundle into the second bundle in an open docking position. The second bundle provides the lock members facing toward the first bundle, which lock members in the open docking position engage the lock members of the first bundle and jointly with the lock members of the first bundle form a flow channel for flow in the flow direction. Additionally, a slider for connecting and separating such locks is provided.

22 Claims, 5 Drawing Sheets

LOCK WITH TWO PROFILE STRIPS AND SLIDERS FOR CONNECTING AND SEPARATING SUCH LOCKS

CROSS REFERENCE TO RELATED APPLICATIONS

This application claims priority from German Ser. No. 20 2010 015 525.8 filed Nov. 18, 2010, the entire contents of which are incorporated herein by reference.

FIGURE SELECTED FOR PUBLICATION

FIG. 6

BACKGROUND OF THE INVENTION

1. Field of the Invention

The present invention relates to a lock system and method involving profile strips and a slider for connecting and separating such a lock system. More particularly, the present invention relates to system and method for slidably securing bounded volumes.

2. Description of the Related Art

Liquid or solid bulk materials are often held in bundles. The bundles may be at least partially-flexibly configured as bundles. Such bundles are, for example, obtained as sacks that are hung in containers. Preferably the bundles are manufactured from endless hoses and closed in various ways and means as hose sections. Especially frequently, such bundles are used for packaging, transporting or storing liquid or solid bulk materials. The term bundle in this application comprises not only completely closed flexible bags, but also for example an adapter that is flexible and open on at least two sides, that can be attached to a device or a container.

During operation, emptying, filling or re-filling such bundles in practice turns out to be difficult or even risky. Particularly when the bulk material of the bundles is dangerous or sensitive, contamination of the bulk material as well as contamination of the environment by bulk material is to be avoided. For this all the locks and connections, especially for docking such bundles, must be manufactured to be as environmentally sealed as possible. With these problems as a background, limited special locks for the bundles described initially have been developed which are to provide support to prevent contamination in the particular case.

Such locks can be perceived for example for DE 10 2004 003 511 B4, the entire contents of which are incorporated herein by reference. However, as regards the stability of the connections, such locks are often not sufficiently safe and provide a substantial detriment.

Accordingly, there is a need for an improved system that overcomes at least one of the concerns noted above.

ASPECTS AND SUMMARY OF THE INVENTION

The proposed invention provides a lock system involves a first lock and a second lock each with two profile strips operable for engagement with an at least partially flexible bundle and effective to enable an environmentally-sealed connection of a first bundle with a second bundle in a closed docking position and for an environmentally-sealed guidance of a flow in a flow direction (D) through the lock members from the first bundle into the second bundle in an open docking position. The second bundle provides similar lock members facing toward the first bundle, which lock members in the opened docking position engage the lock members of the first bundle and jointly with the lock members of the first bundle forms a flow channel for flow in the flow direction. Additionally the invention relates to a slider for connecting and separating such locks. The slider has an insertion side on which the locks are insertable in insertion directions (A, B) which enclose an acute angle (γ) in which the slider is insertable, and opposite the insertion side an outlet side on which the locks connected there with each other can be removed in a joint sliding direction (C) from the slider.

At least one problem that is the basis for the invention is to provide a lock for a bundle, which makes possible an environmentally-sealed connection of such bundles with each other or with other procedural mechanisms, as well as environmentally-sealed guidance for a flow between bundles connected with each other or the connected devices. In addition, it is proposed in one embodiment that the proposed system and method is effective for substantially universal use on at least one at least partially flexible bundle, also without the lock needing to be part of the bundle. It is preferable that between the bundles such locks should produce as secure a connection as possible, which does not tear especially when impulses occur along the flow direction. Also, the locks are to be produced in preferably as cost-effective a manner as possible, in the best case as piece goods without substantial re-working or assembly.

An aspect of the present invention is thus to provide a locking system with two profile strips with features as noted and a slider member in an effort to overcome at least one of the detriments noted. It will also be understood that an aspect of the present invention is to provide a method for operating such a system in the matter discussed herein.

In addition, according to a further refinement of the invention, there is provided a system and method for an environmentally-sealed linkage of a first bundle with a second bundle, so that a through flow can be guided in environmentally-sealed fashion in a flow direction through the lock from the first bundle into the second bundle in an open docking position.

As discussed herein facing a first bundle, the second bundle has an identical lock, which can be operated in the proposed manner and made to engage the lock of the first bundle to attain the opened docking position. In this opened docking position the connected locks of the bundle form a channel for flow of the bulk goods in the flow direction.

As ill be understood from study of the entire disclosure, the lock system and method comprises two profile strips for locking the at least partially flexible bundle: a wide profile strip and a narrow profile strip. The wide profile strip extends out in the flow direction via the bundle and the narrow profile strip oriented parallel to the first profile strip. Both profile strips comprise locking elements oriented exclusively transverse to the flow direction, which are meant to engage with each other in the manner of an interlocked connection.

All of the locking elements of the profile strips are oriented transverse to the flow direction, into the channel or out of the channel, so that loads in the flow direction can be compensated with a high level of safety. In the flow direction when one bulk product is poured for example from the first bundle into the second bundle, impulse loads occur on the locks if the bulk goods fall on the floor of the second bundle. The locking elements placed transverse to the flow direction withstand such impulses in the flow direction, since they effectively prevent a stripping off of the profile strips.

In advantageous fashion, and during operation of the method, the bundles can be and are pressed laterally against each other with identically configured locks, to produce environmentally-sealed connections of the profile strips with each other. Lateral pressing against each other also leads, when a bundle is locked with the lock, to a safe connection, as well as when the identical lock is pressed laterally on the lock, to create a flow between two bundles. In this case two bundles are docked to each other.

For the user, lateral docking in addition to the strength of the connection and has a practical advantage in that a lateral arrangement of the bundles to each other is considerably more comfortable to implement. For example, an empty bundle can readily be made to come to a full bundle. To dock the bundles to each other, neither of the bundles needs to be moved vertically, since docking is laterally provided (relative to a bundle direction).

For connecting and parting of the locks, a slider is provided and is operatively removable from the locks between uses. The slider is operative to slide up to the closed locks to make connection transverse to the flow direction by engaging the related profile strips and locking elements as will be discussed.

Oriented in the flow direction and lying opposite, the slider has an insertion side and an outlet side. On the insertion side the locks of the two bundles can be inserted in insertion directions. The insertion directions run transverse to the flow direction and cross at an acute angle. During use, in the angle, oriented to each other, the locks on the insertion side are inserted into the slider. On the outlet side, the locks connected with each other by means of the slider are guided out of the slider in a common sliding direction, with the respective lock, viewed for itself, first being locked.

Additionally, the locking elements acting between the profile strips are advantageously loosen-able in a controlled fashion by means of an actuator either between the profile strips of a lock or between the profile strips of two locks, so that the bundles avoid an uncontrolled opening. The actuator can, for example, be operated manually, especially as actuators configured as straps. According to the invention this occurs after the sliders have connected the locks with each other. The straps are pulled laterally apart from each other. With this the desired locking elements become loose, according to on what straps at what angle a lateral tension is applied according to the method of use.

A configuration of locking elements for acting together in an interlocking connection is advantageous, because an appropriate extrusion of the profile strips as plastic strips can be shaped in especially favorable geometric forms. Aside from that, the locking elements thus shaped lock especially well due to the normally weak and small wall thickness of the bundles. Such embodiment forms of stronger locking elements are especially robust and stable against multiple loadings, and in addition interlock securely until they are loosened from the interlocking in a reverse of the locking method employed. For this they can be angled off parallel to the flow direction from the profile strips so that each locking element separates in turn The above, and other aspects, features and advantages of the present invention will become apparent from the following description read in conduction with the accompanying drawings, in which like reference numerals designate the same elements.

BRIEF DESCRIPTION OF THE DRAWINGS

The invention is described detail below on the basis of exemplary embodiments with reference to the accompanying figures, in which.

DETAILED DESCRIPTION OF THE PREFERRED EMBODIMENTS

Figure 1:
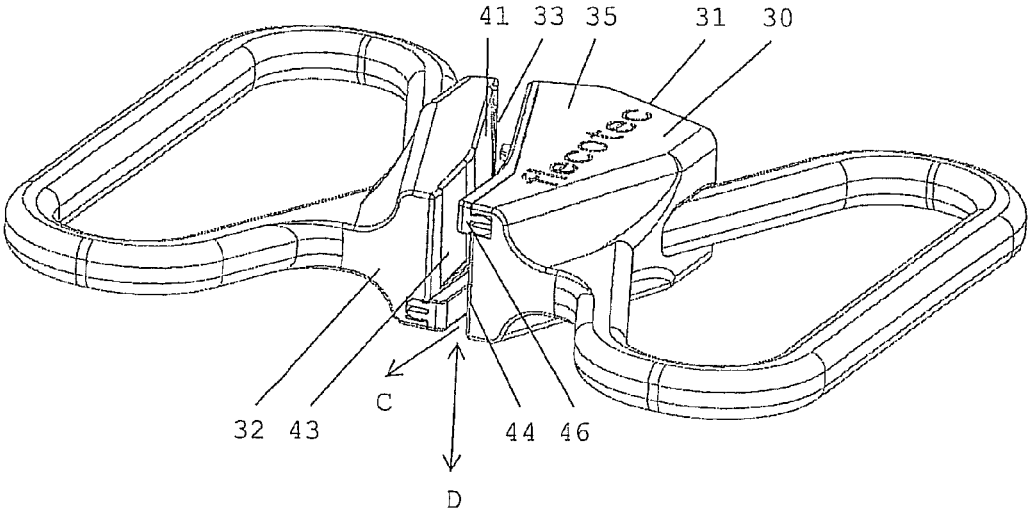
FIG. 1 is a perspective view of a slider with a slanted view of its exit side.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Figure 2:
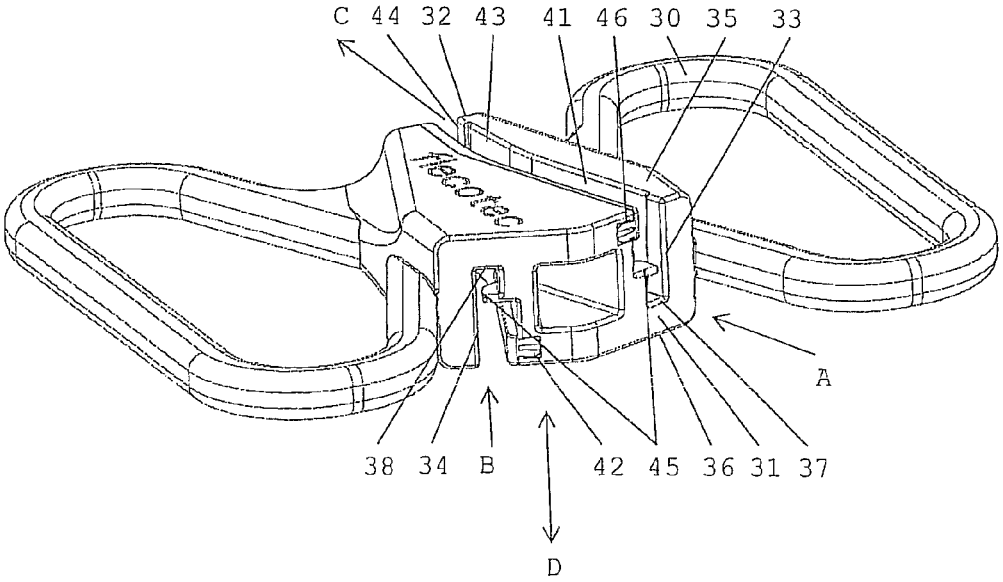
FIG. 2 is a perspective view of the slider of FIG. 1 with a slanted view of the insertion side.

Referring now to FIGS. 1 and 2, and generally through all FIGS. 1-6, a slider 30 is depicted according to an embodiment example in a perspective view from two sides, an insertion side 31 and an outlet side 32 of slider 30. The perspective views of FIGS. 1 and 2 are supplemented by the perspective views of FIGS. 3 and 4 in that two locks 10, 20 are shown inserted into slider 30 with no bundle.

Figure 3:
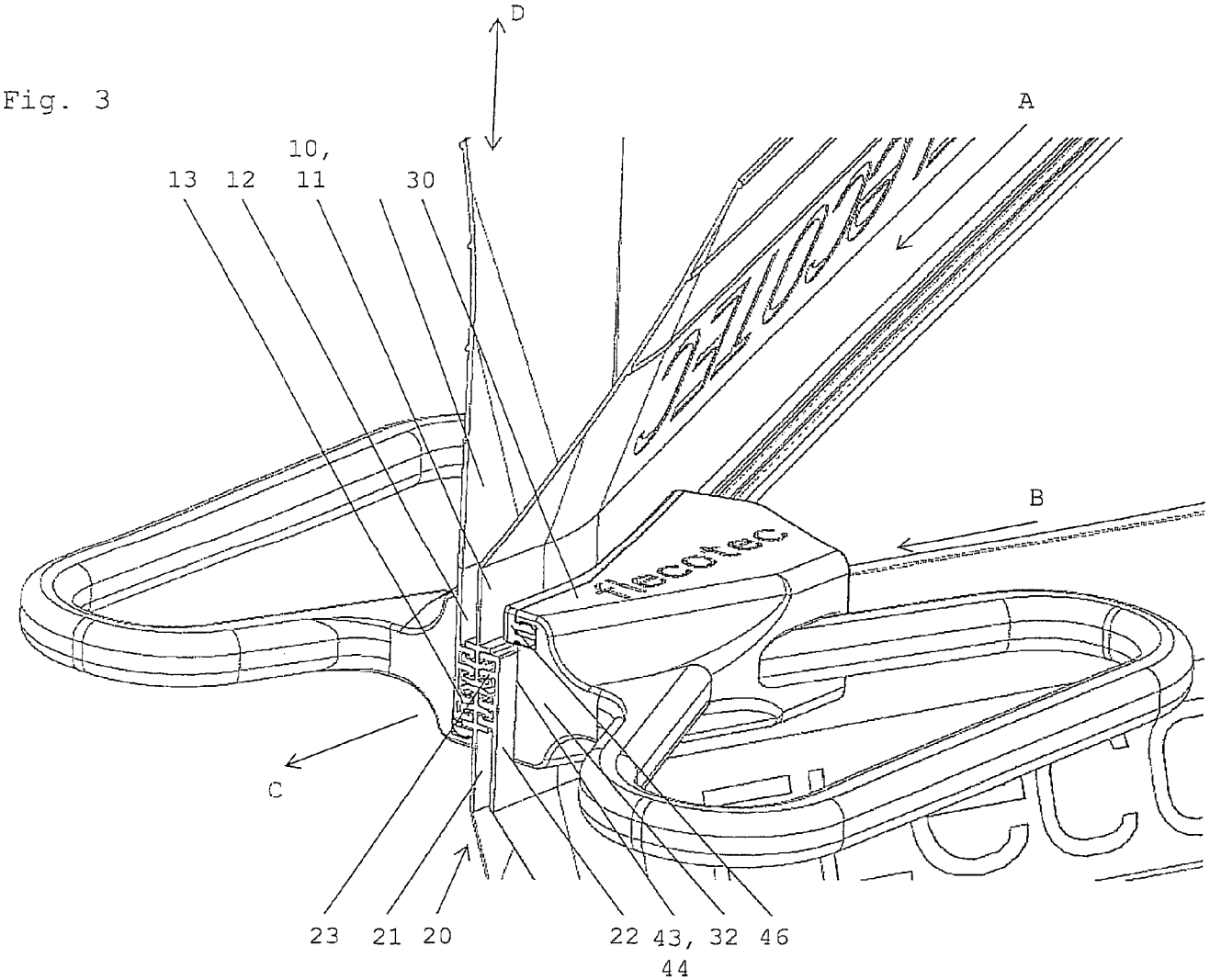
FIG. 3 is a partial perspective view of the exit side of the slider of FIG. 1, with a slanted view of its exit side with no bundles, locked by two locks guided through the slider and connected during a use by means of the slider
Figure 4:
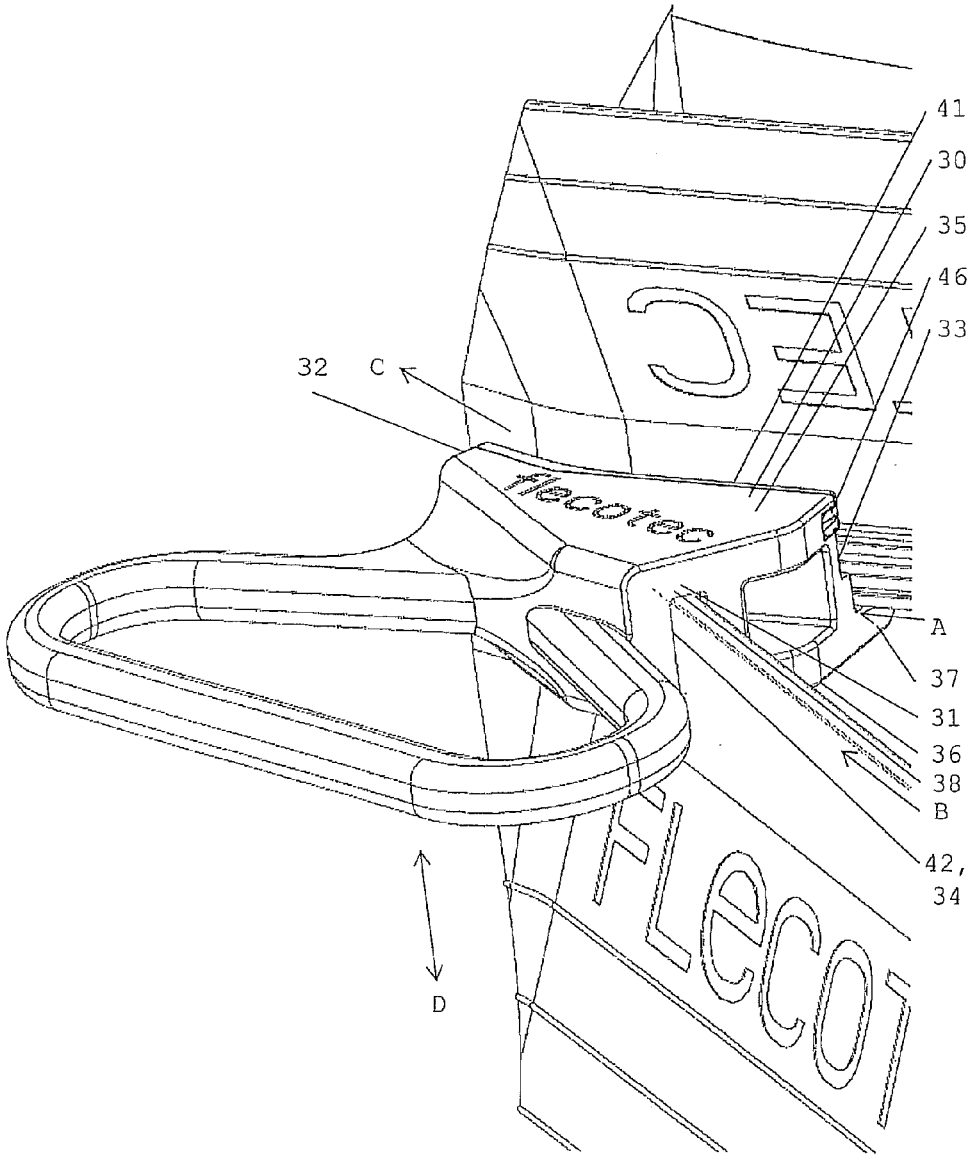
FIG. 4, is a partial perspective view of the insertion side of the slider of FIG. 2, with no bundles and with two locks locked in the insertion direction into the slider and run through the slider from right to left on the page for joining together thereof.
Figure 5:
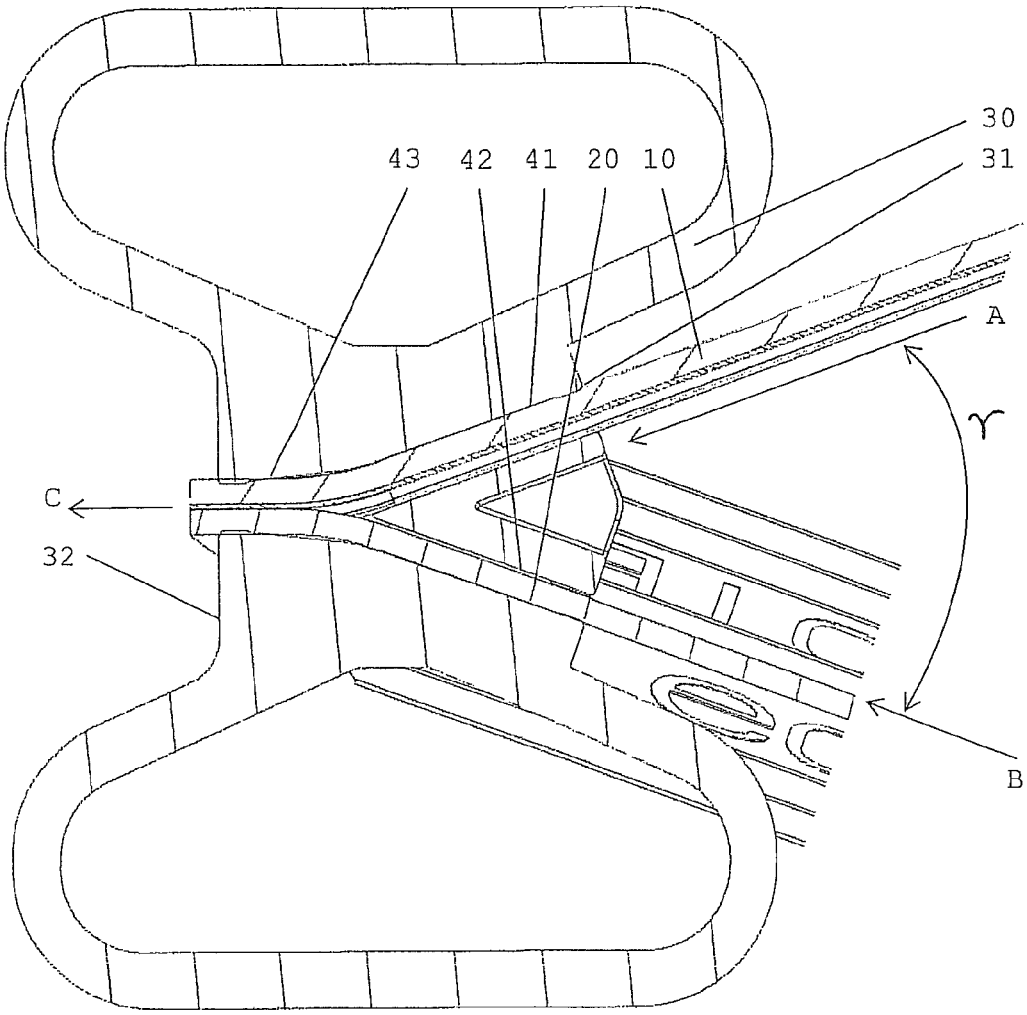
FIG. 5 is a partial sectional illustration of a slider with inserted locks as noted in FIGS. 3 and 4 through a plane defined along the insertion direction.
Figure 6:
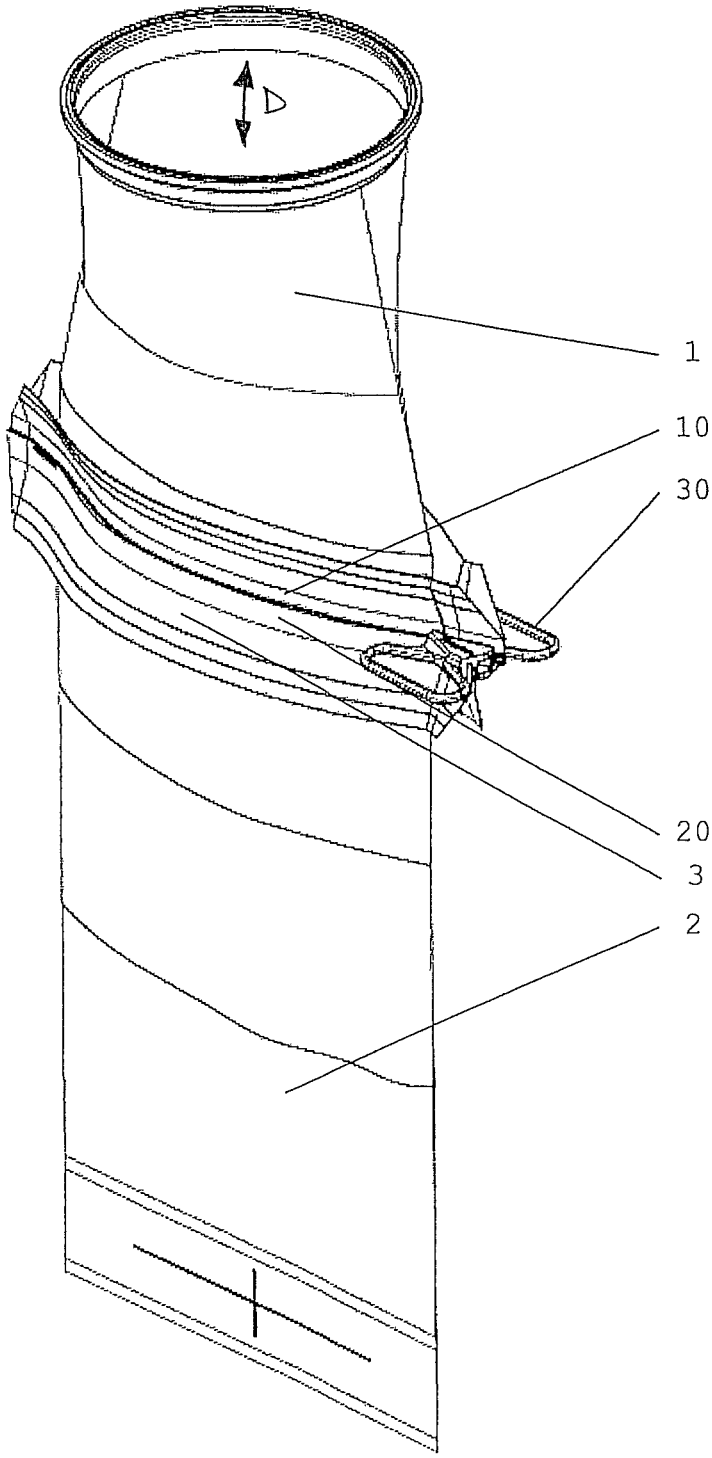
FIG. 6 is a perspective view of two bundles connected to each other through the slider in an opened docking position.

FIG. 5 shows a section through the plane of slider 30 with inserted locks 10, 20 as per FIGS. 3 and 4 through a plane which is set via insertion directions A, B, in which locks 10, 20 have been inserted into slider 30. FIG. 6 shows slider 30 as per the embodiment example from FIG. 1 in an open docking position of two bundles 1, 2 which are equipped with one of the locks 10, 20 as per FIGS. 3 and 4.

Identical parts are provided with similar reference symbols. To afford a better view, not all reference symbols are indicated in all the figures but will be understood by those of skill in the art having studied the disclosure.

The slider 30 comprises a body with two wing-like handles attached on opposite sides on the longitudinal sides. The body has roughly the shape of a cuboid. Joining the longitudinal sides with each other, as further longitudinal sides along the insertion directions A, B, the body has a first cover side 35 and an opposite second cover side 36.

On the front side, slider 30 comprises an insertion side 31 transverse to insertion directions A, B. On insertion side 31 the locks 10, 20 are insertable in insertion directions A, B into slider 30, wherein the insertion directions A, B enclose an acute angle $\gamma$. Opposite insertion side 31, slider 30 comprises an outlet side 32. On outlet side 32, the locks 10, 20 that are connectable to each other via slider 30 and locked are able to be brought out in a common sliding direction C through a gap 44 that is run through slider 30 oriented in a flow direction D, out of slider 30. The gap 44 is open toward the two cover sides 35, 36.

On the insertion side, slider 30 has a first U-shaped cross section 33 that is open toward the first cover side 35, transverse to one of the insertion directions A. The first U-shaped cross section connects two legs with each other with a first base 37 which legs terminate in the first cover side 35. The legs have contours facing toward each other that are fitted to locks 10, 20.

Adjoining the first U-shaped cross section and specular as regards a plane (FIG. 5) extended through insertion directions A, B, slider 30 comprises a second U-shaped cross section 34 open to the second cover side 36, and running transverse to the other insertion direction B. Its second base 38 which also connects two legs with each other faces away from first base 37. The two legs of the second U-shaped cross section likewise terminate in open fashion in the second cover side 36. Also, at least one of these legs is fitted to the locks 10, 20 with a contour.

The lock 10, 20 comprises two profile strips 11, 12; 21, 22 for an at least partially flexible bundle 1, 2 (FIG. 6) for environmentally-sealed connection of a first bundle 1 with a second bundle 2 and for environmentally-sealed guidance of a flow in flow direction D through the lock 10, 20 from first bundle 1 into second bundle 2 in an opened docking position. Second bundle 2 has an identical lock 10, 20 facing first bundle 1.

In the opened docking position as per FIG. 6, lock 10 of first bundle 1 is engaged with lock 20 of second bundle 2. The locks 10, 20 thus jointly form a flow channel 3 for flow in flow direction D.

According to FIGS. 3 to 5, profile strips 11, 12; 21, 22 are placed opposite each other; they pick up bundle 1, 2 between them and close it. The wider of the profile strips 12, 22 extends in flow direction D via the narrower of the profile strips 11, 21. Both profile strips 11, 12; 21, 22 comprise locking elements 13, 13 oriented exclusively transverse to flow direction D, both out of the channel and into the channel. The locking elements 13, 23 securely engage with each other in the manner of an interlocked connection.

As per FIGS. 3 to 5, by means of appropriately placed first and second bases 37, 38, the locks 10, 20 placed opposite each other are insertable into U-shaped cross sections 33, 34—in a method of using. In use, the first lock 10 is guided with a projecting locking element 13 to about the height of an additional locking element of narrow profile strip 21 of second lock 20.

The slider 30 exhibits U-shaped cross sections 33, 34 and gap 44 joining inlet channels 41, 42 and an outlet channel 43. The inlet channels 41, 42 are oriented transverse to flow direction D and opened with the U-shaped cross sections 33, 34. According to the embodiment example of FIGS. 3 to 5 they are closed on three sides and empty out roughly in the center in slider 30 in outlet channel 43. The locks 10, 20 are guided through in the insertion directions A, B in the angle γ toward each other through insertion channels 41, 42 into outlet channel 43 and through it. The outlet channel 43 terminates on the outlet side 32 in gap 44.

In the insertion channels 41, 42 facing away from the base 37, 38 as well as in the outlet channel 43, slider 30 has grooves running transverse to flow direction D graduating in an area of the particular cover side 35, 36. In use, into the grooves, guide rails 46 are inserted, here clipped in. The guide rails 46 narrow insertion channels 41, 42 and outlet channel 43 of the cover side 35, 36 facing, to hold a lock 10, 20 in the guide.

In the insertion channels 41, 42 on the insertion side a stopper 45 is provided which prevents slider 30 from sliding out of the locks 10, 20 connected with each other. During use, the stopper 45 acts together with a local alteration of at least one of the profile strips 11, 12; 21, 22. In advantageous fashion, in use a welded seam oriented in flow direction D is placed on or in profile strips 11, 12; 21, 22 as the local alteration.

LIST OF REFERENCE SYMBOLS

1 first bundle
2 second bundle
3 Flow channel
10 first lock
11 first narrow profile strip
12 first wide profile strip
13 first projecting lock element
20 second lock
21 second narrow profile strip
22 second wide profile strip
23 second projecting lock element
30 slider
31 insertion side
32 exit side
33 U-shaped cross section
34 second U-shaped cross section
35 first cover side
36 second cover side
37 first base
38 second base
41 first insertion channel
42 second insertion channel
43 outlet channel
44 gap
45 stopper
46 guide rail
γ angle
A insertion direction
B additional insertion direction
C sliding direction
D Flow direction In the claims, means or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

The invention claimed is:

1. A lock system for enabling a sealed connection between a first bundle and a second bundle in a closed docking position comprising:

a first lock on said first bundle having a first narrow profile strip and a first wide profile strip;

a second lock on said second bundle having a second narrow profile strip and a second wide profile strip;

said first lock and said second lock extending respectively from proximate ends of respective said first bundle and said second bundle and positioned for operative engagement therebetween;

said first narrow profile strip, said first wide profile strip, and said second narrow profile strip, and said second wide profile strip extending from respective first and second bundles along respective bundle widths that are generally transverse to a longitudinal direction between the bundles;

a plurality of locking elements projecting from each said profile strip;

each locking element is oriented transversely to said longitudinal direction;

said first narrow profile strip and said second narrow profile strip having said locking elements along proximate ends thereof and extending on opposing respective sides of each said first narrow profile strip and said second narrow profile strip;

said first wide profile strip and said second wide profile strip having said locking elements along proximate ends thereof and extending on only one side of each said first wide profile strip and said second wide profile strip;

said locking elements of said first wide profile strip being releasably engageable with said respective locking elements on said first narrow profile strip and on said second narrow profile strip; said locking elements of said second wide profile strip being releasably engagable with said respective locking elements on said first narrow profile strip and on said second narrow profile strip;

a slider slidably operably and removably engageable with each said first lock and said second lock during a use of said lock system; and said slider including at least one device that slidably receives and secures said plurality of locking elements on each of said first lock and said second lock during an engagement thereof along an engaging direction and for slidably separating and releasing said plurality of locking elements on each of said first lock and said second lock during a disengagement thereof along a disengaging direction.

2. The lock system, according to claim 1, wherein:

said slider further comprises:

an insertion side having a first insertion channel and a second insertion channel having an acute angle therebetween;

an outlet side having a single outlet channel in an operative communication with each of said first insertion channel and said second insertion channel; and said first insertion channel, said second insertion channel, and said outlet channel arranged generally transverse to said longitudinal direction.

3. The lock system, according to claim 2, wherein:

said slider has a first surface proximate one of said first and second insertion channels;

said slider has a second surface opposite said first surface and proximate said other of said first and second insertion channels; and said single outlet channel extends from said first surface to said second surface.

4. The lock system, according to claim 3, further comprising:

at least one stopper element in each of said first insertion channel and said second insertion channel;

said stopper element in said first insertion channel engaging respectively said first narrow profile strip and said first wide profile strip of said first lock;

said stopper element in said second insertion channel engaging respectively said second narrow profile strip and said second wide profile strip of said second lock; and said at least one stopper element in each said first and said second insertion channel operable to prevent a removal of said first and said second lock from said slider along said longitudinal direction during said use.

5. The lock system, according to claim 4, wherein:

said first insertion channel further comprises a generally U-shaped cross section having first base member;

said second insertion channel further comprises a generally U-shaped cross section having a second base member; and said first and said second base members arranged parallel to each other.

6. The lock system, according to claim 5, wherein:

said first insertion channel further includes a first guide rail;

said second insertion channel further includes a second guide rail; and each of said first guide rail and said second guide rail operatively engages respectively said first lock and said second lock during said use to guide respectively said locks from said insertion side to said outlet side.

7. The lock system, according to claim 6, wherein:

said first and said second insertion channels taper along said acute angle to said outlet side.

8. A method for using a lock system to enable a sealed connection between a first bundle and a second bundle in a closed docking position, said method comprising the steps of:

(a) providing a first lock on said first bundle having a first narrow profile strip and a first wide profile strip;

(b) providing a second lock on said second bundle having a second narrow profile strip and a second wide profile strip;

(i) said first lock and said second lock extending respectively from proximate ends of respective said first bundle and said second bundle and positioned for operative engagement therebetween;

(c) positioning said first narrow profile strip, said first wide profile strip, and said second narrow profile strip, and said second wide profile strip extending from respective first and second bundles along respective bundle widths that are generally transverse to a longitudinal direction between the bundles;

(d) providing a plurality of locking elements projecting from each said profile strip, wherein each locking element is oriented transversely to said longitudinal direction;

(i) said first narrow profile strip and said second narrow profile strip having said locking elements along proximate ends thereof and extending on opposing respective sides of each said first narrow profile strip and said second narrow profile strip;

(ii) said first wide profile strip and said second wide profile strip having said locking elements along proximate ends thereof and extending on only one side of each said first wide profile strip and said second wide profile strip;

(iii) said locking elements of said first wide profile strip being releasably engageable with said respective locking elements on said first narrow profile strip and on said second narrow profile strip;

(iv) said locking elements of said second wide profile strip being releasably engagable with said respective locking elements on said first narrow profile strip and on said second narrow profile strip;

(e) providing a slider slidably operable and removably engageable with each said first lock and said second lock during a use of said lock system;

(f) providing in said slider at least one device that slidably receives and secures said plurality of locking elements on each of said first lock and said second lock; and, during a disengaging use thereof, enables a separating and releasing of said plurality of locking elements on each of said first lock and said second lock along a disengaging direction, whereby said slider enables said sealed connection between said first bundle and said second bundle in the closed docking position;

(g) engaging said slider with respective said first lock and said second lock along an engaging direction and during a sliding thereof receiving and securing respective said locking elements.

9. The method, according to claim 8, further comprising the steps of:

(h) sliding said slider along the disengaging direction relative to said first lock and said second lock; and said disengaging direction being opposite said engaging direction.

10. The method, according to claim 8, further comprising the steps of:

(i) providing said slider with:

an insertion side having a first insertion channel and a second insertion channel having an acute angle therebetween;

an outlet side having a single outlet channel in an operative communication with each of said first insertion channel and said second insertion channel; and said first insertion channel, said second insertion channel, and said outlet channel arranged generally transverse to said longitudinal direction.

11. The method, according to claim 10, wherein:

said slider having a first surface proximate one of said first and second insertion channels;

said slider having a second surface opposite said first surface and proximate said other of said first and second insertion channels; and said single outlet channel extending from said first surface to said second surface.

12. The method, according to claim 11, wherein:

said first insertion channel further comprises a generally U-shaped cross section having first base member;

said second insertion channel further comprises a generally U-shaped cross section having a second base member; and said first and said second base members are arranged parallel to each other.

13. The method, according to claim 10, further comprising the steps of:

(j) providing at least one stopper element in each of said first insertion channel and said second insertion channel;

said stopper element in said first insertion channel engaging respectively said first narrow profile strip and said first wide profile strip of said first lock;

said stopper element in said second insertion channel engaging respectively said second narrow profile strip and said second wide profile strip of said second lock; and (k) operating said at least one stopper element in each said first and said second insertion channel to prevent a removal of said first and said second lock from said slider along said longitudinal direction during said use.

14. The method, according to claim 13, further comprising the steps of:

(l) providing a first guide rail in said first insertion channel;

(m) providing a second guide rail in said second insertion channel; and (n) engaging each of said first guide rail and said second guide rail operatively and respectively with said first lock and said second lock during said use to guide respectively said locks from said insertion side to said outlet side.

15. A lock system for connecting a first bundle and a second bundle, comprising:

a first lock on the first bundle having a first narrow profile strip and a first wide profile strip;

a second lock on the second bundle having a second narrow profile strip and a second wide profile strip;

the profile strips extending from respective first and second bundles along a longitudinal direction;

each profile strip including locking elements oriented transverse to the longitudinal direction;

the locking elements being configured to engage with each other to connect the first and second locks to define a locked state of the bundles; and a slider being configured to slide along the locks to connect the locking elements and separate the locking elements.

16. The lock system, according to claim 15, wherein:

the slider comprises:

an insertion side configured to receive the locks along insertion directions, the insertion directions defining an acute angle therebetween; and an opposite outlet side, through which the locks extend along a common sliding direction.

17. The lock system, according to claim 15, wherein:

the slider comprises:

a first cover side and an opposite, second cover side situated parallel to each other and transverse to the longitudinal direction;

a first u-shaped cross section opening toward the first cover side; and a second u-shaped cross section opening toward the second cover side.

18. The lock system, according to claim 17, wherein:

the first u-shaped cross section defines a first insertion channel;

the second u-shaped cross section defines a second insertion channel;

the first and second insertion channels converge into a single exit channel; and the locks are guidable in insertion directions into the first and second insertion channels and out of the single exit channel.

19. The lock system, according to claim 18, wherein:

the slider further comprises at least one stopper configured to prevent removal of the locks from the slider along the longitudinal direction during use.

20. The lock system, according to claim 19, wherein the at least one stopper comprises a plurality of stoppers, the plurality of stoppers arranged in the insertion channels.

21. The lock system, according to claim 17, wherein:

the slider further comprises grooves configured to guide at least one of the locks, the grooves running transverse to the longitudinal direction.

22. The lock system, according to claim 21, wherein the grooves are situated in the u-shaped cross sections or the cover sides, and wherein guide rails are mountable in the grooves.

* * * * *